US012674591B2

(12) United States Patent
Harris et al.

(10) Patent No.: US 12,674,591 B2
(45) Date of Patent: Jul. 7, 2026

(54) SLEEVED TILE ROOF RIDGE VENT

(71) Applicant: Marco Industries Inc., Tulsa, OK (US)

(72) Inventors: Robert P. Harris, Tulsa, OK (US); Robert C. Carnick, Tulsa, OK (US)

(73) Assignee: MARCO INDUSTRIES INC., Tulsa, OK (US)

( * ) Notice: Subject to any disclaimer, the term of this patent is extended or adjusted under 35 U.S.C. 154(b) by 297 days.

(21) Appl. No.: 18/345,210

(22) Filed: Jun. 30, 2023

(65) Prior Publication Data

US 2024/0183549 A1 Jun. 6, 2024

Related U.S. Application Data

(60) Provisional application No. 63/429,430, filed on Dec. 1, 2022.

(51) Int. Cl.
*F24F 7/02* (2006.01)
*E04D 13/17* (2006.01)

(52) U.S. Cl.
CPC ..... *F24F 7/02* (2013.01); *E04D 13/174* (2013.01); *F24F 2221/52* (2013.01)

(58) Field of Classification Search
CPC ..... F24F 7/02; F24F 2221/52304
See application file for complete search history.

(56) References Cited

U.S. PATENT DOCUMENTS 429,937 A 6/1890 Mitchell
2,300,842 A 11/1942 Leslie
2,318,820 A 5/1943 Voigt et al.
2,470,201 A 5/1949 Werner
2,490,220 A 12/1949 Leslie
3,492,192 A 1/1970 Bullard
3,884,009 A 5/1975 Frohlich et al.
3,949,657 A 4/1976 Sells
4,024,685 A 5/1977 Aarons
4,189,886 A 2/1980 Fohlich et al.
4,189,989 A 2/1980 Maze
4,280,399 A 7/1981 Cunning
(Continued)

FOREIGN PATENT DOCUMENTS

CN 212984379 U 4/2021
DE 19643591 A1 4/1998
(Continued)

OTHER PUBLICATIONS

Korean Intellectual Property Office, "PCT International Search Report and Written Opinion," mailed Jul. 23, 2014, for International Application No. PCT/US2014/027897, 12 pages.
(Continued)

*Primary Examiner* — Steven B McAllister
*Assistant Examiner* — Michael James Giordano
(74) *Attorney, Agent, or Firm* — Dorsey & Whitney LLP

(57) ABSTRACT

A sleeved tile roof ridge vent (STRV) and the method of its use and construction are disclosed. The STRV may include a vent body including one or more holes and a perforated barrier coupled to the vent body to cover the one or more holes. The STRV further includes a splash guard coupled to the perforated barrier to limit debris, such as wind driven rain, from entering through perforations in the perforated barrier. Additional systems and methods are also provided.

20 Claims, 9 Drawing Sheets

(56) References Cited

U.S. PATENT DOCUMENTS 4,325,290 A 4/1982 Wolfert
4,545,291 A 10/1985 Kutsch et al.
4,545,292 A 10/1985 Inokawa et al.
4,558,637 A 12/1985 Mason
4,570,396 A 2/1986 Struben
4,598,505 A 7/1986 Mcgown
4,643,080 A * 2/1987 Trostle ..... F24F 7/02 52/716.2
4,689,264 A 8/1987 Fink et al.
4,754,589 A 7/1988 Leth
4,788,801 A 12/1988 Jones
4,843,953 A 7/1989 Sells
4,876,950 A 10/1989 Rudeen
4,924,761 A 5/1990 Macleod et al.
4,957,037 A 9/1990 Tubbesing et al.
4,995,308 A 2/1991 Waggoner
5,002,816 A 3/1991 Hofmann et al.
5,009,149 A 4/1991 Macleod et al.
5,018,748 A 5/1991 Schalle
5,022,203 A 6/1991 Boyd
5,030,507 A 7/1991 Mudge et al.
5,050,489 A 9/1991 Mankowski
5,060,431 A 10/1991 Macleod et al.
5,092,225 A 3/1992 Sells
5,095,810 A 3/1992 Robinson
5,122,095 A 6/1992 Wolfert
5,167,579 A 12/1992 Rotter
5,174,076 A 12/1992 Schiedegger et al.
5,235,016 A 8/1993 Vafa et al.
5,288,269 A 2/1994 Hansen
5,304,095 A 4/1994 Morris
5,326,318 A 7/1994 Rotter
5,328,407 A 7/1994 Sells
5,331,783 A 7/1994 Kasner et al.
5,332,393 A 7/1994 Godl
5,352,154 A 10/1994 Rotter et al.
5,353,154 A 10/1994 Lutz et al.
5,425,672 A 6/1995 Rotter
5,427,571 A 6/1995 Sells
5,439,417 A 8/1995 Sells
5,458,538 A 10/1995 Macleod et al.
5,473,847 A 12/1995 Crookston
5,542,882 A 8/1996 Sells
5,561,953 A 10/1996 Rotter
5,593,348 A 1/1997 Rickert
5,603,657 A 2/1997 Sells
5,803,805 A 9/1998 Sells
5,816,014 A 10/1998 Tzeng et al.
5,826,383 A 10/1998 Garrison
5,867,956 A 2/1999 Gregory et al.
5,921,863 A 7/1999 Sells
5,924,925 A 7/1999 Nystrom
5,947,817 A 9/1999 Morris et al.
6,077,159 A 6/2000 Clayton
6,079,166 A 6/2000 Mason et al.
6,125,602 A 10/2000 Freiborg et al.
6,149,517 A 11/2000 Hansen
6,155,008 A 12/2000 Mckee
6,267,668 B1 7/2001 Morris
6,298,613 B1 10/2001 Coulton et al.
6,308,472 B1 10/2001 Coulton et al.
6,308,473 B1 10/2001 Auck
6,362,016 B1 3/2002 Funato et al.
6,418,678 B2 7/2002 Rotter
6,450,882 B1 9/2002 Morris et al.
6,458,029 B2 10/2002 Morris
6,491,581 B1 12/2002 Mankowski
6,599,184 B2 7/2003 Morris
6,647,675 B1 * 11/2003 Castellanos ..... E04D 12/008 52/302.3
6,662,510 B2 12/2003 Rotter
6,767,281 B2 7/2004 Mckee
6,773,342 B2 8/2004 Rotter
6,780,099 B1 8/2004 Harper
6,944,997 B2 9/2005 Verkamp
6,966,156 B2 11/2005 Dixon
6,997,800 B1 * 2/2006 Kohler ..... E04D 13/178 454/365
7,566,265 B2 7/2009 Reeves
7,594,363 B2 9/2009 Polumbus et al.
8,024,897 B2 9/2011 Polumbus et al.
8,037,643 B1 10/2011 Anderson
8,075,376 B1 12/2011 Inzeo
8,083,576 B2 12/2011 Rotter
8,276,331 B2 10/2012 Polumbus et al.
8,291,655 B2 * 10/2012 McGlothlin ..... E04D 3/40 52/198
8,302,352 B2 11/2012 Bahn et al.
8,650,833 B1 2/2014 Polston
8,782,967 B2 7/2014 Daniels
8,790,167 B2 7/2014 Holland et al.
9,151,059 B2 10/2015 Pavlansky et al.
9,243,813 B2 1/2016 Mantyla et al.
9,334,655 B2 5/2016 Polumbus et al.
9,447,583 B2 9/2016 Tovmasyan
9,845,968 B2 12/2017 Couto
10,590,654 B2 3/2020 Polumbus et al.
10,676,935 B1 6/2020 Huang
10,746,421 B2 8/2020 Fiser
11,519,617 B2 12/2022 Oddy
11,739,532 B1 8/2023 Robida
2002/0032000 A1 3/2002 Lawless, III et al.
2002/0194799 A1 12/2002 Sharp et al.
2003/0022618 A1 1/2003 Miller
2003/0051419 A1 3/2003 Suzuki
2003/0077999 A1 4/2003 Mankowski
2004/0000101 A1 1/2004 Dixon
2004/0137185 A1 7/2004 Sieber et al.
2005/0048912 A1 3/2005 Rotter
2005/0106360 A1 5/2005 Johnston et al.
2005/0202779 A1 9/2005 Smith
2005/0233691 A1 10/2005 Horton
2005/0239392 A1 10/2005 Sells
2005/0241248 A1 11/2005 Ridenour
2006/0019598 A1 1/2006 Rotter
2006/0040608 A1 * 2/2006 Coulton ..... E04D 13/176 454/365
2006/0116069 A1 6/2006 Urbanski et al.
2006/0121845 A1 6/2006 Sells
2006/0223436 A1 10/2006 Matyja
2007/0072539 A1 3/2007 Sells
2007/0093197 A1 4/2007 Shah
2007/0173191 A1 7/2007 Daniels et al.
2009/0113823 A1 5/2009 Osborne
2009/0130047 A1 5/2009 Weiss et al.
2009/0298370 A1 12/2009 Rock
2010/0184366 A1 7/2010 Hassenstab
2011/0209433 A1 9/2011 Polumbus
2011/0312265 A1 12/2011 Leblanc
2013/0046055 A1 2/2013 Michl et al.
2013/0344796 A1 12/2013 Rossetta
2014/0065946 A1 3/2014 Tovmasyan
2016/0138270 A1 5/2016 Rotter
2016/0146499 A1 * 5/2016 Sherry ..... F24F 13/085 454/367
2017/0059184 A1 3/2017 Haynes et al.
2017/0146253 A1 5/2017 Mantyla et al.
2018/0328040 A1 * 11/2018 Siri ..... E04D 13/004
2018/0328041 A1 11/2018 Bourque
2021/0238858 A1 8/2021 Polumbus et al.
2023/0228092 A1 7/2023 Robida
2023/0243528 A1 8/2023 Vallery et al.
2024/0003560 A1 1/2024 Allaster et al.
2024/0175588 A1 5/2024 Harris et al.
2024/0183550 A1 6/2024 Vallery et al.

FOREIGN PATENT DOCUMENTS

FR 2966228 A1 4/2012
JP 07-109797 4/1995
JP 07109797 A 4/1995
JP 07157960 A 6/1995
JP 2012087618 A 5/2012

(56) References Cited

FOREIGN PATENT DOCUMENTS

| | | | |
|---|---|---|---|
| WO | 9119868 | A1 | 12/1991 |
| WO | 95/21975 | A1 | 8/1995 |
| WO | 97/32940 | | 9/1997 |
| WO | 02092930 | A1 | 11/2002 |
| WO | 2014143787 | A1 | 9/2014 |

OTHER PUBLICATIONS

Canadian Intellectual Property Office, "Third Office Action," mailed Jan. 27, 2015, for Canadian Patent Application No. 2,718,316, 10 pages.
Canadian Intellectual Property Office, "First Office Action," mailed Jun. 12, 2012, for Canadian Application No. 2,718,316, 4 pages.
Canadian Intellectual Property Office, "Second Office Action," mailed Mar. 21, 2013, for Canadian Application No. 2,718,316, 5 pages.
European Patent Office, "Communication pursuant to Rules 70(2) and 70a(2) EPC," mailed Jul. 11, 2013, for European Application No. 11748245.5, 8 pages.
European Patent Office, "Supplementary European Search Report," mailed Jun. 24, 2013, for European Application No. 11748245.5, 8 pages.
European Patent Office, "European Search Report," mailed Nov. 11, 2024, for European Application No. 24185162.5, 11 pages.
Total Screen, "California Building Code Chapter 7A—Explained", obtained online at https://totalscreen.com/fire-protection-vent-covers/california-building-code-chapter-7a-explained/, Jan. 1, 2008, 17 pages.
U.S. Patent and Trademark Office, Office, "PCT International Search Report and Written Opinion," mailed Nov. 19, 2025, for PCT Application No. PCT/US2025/047907, 9 pages.
U.S. Patent and Trademark Office, "PCT International Search Report and Written Opinion," mailed Jan. 30, 2026, in PCT Application No. PCT/US2025/047941, 11 pages.

* cited by examiner

SLEEVED TILE ROOF RIDGE VENT

CROSS-REFERENCE TO RELATED APPLICATIONS

This application claims priority to and the benefit of U.S. Provisional Patent Application No. 63/429,430 filed Dec. 1, 2022, and entitled "SLEEVED TILE ROOF RIDGE VENT," which is incorporated by reference in its entirety.

FIELD

This application relates to a sleeved tile roof ridge vent and the method of its use and construction.

BACKGROUND

Ridge ventilation of tile roofs is known. Roof ridge ventilation systems for tile roofs typically require a ridge board installed using separate brackets and the separate installation of two or more vent pieces to support the cap tile and to provide a base for installing vent bodies or the use of a perforated rolled vent. Further, roof ridge ventilation systems on tile roofs may allow wind-driven rainwater and other rainwater to enter a ventilated space through the roof ventilation system or provide inadequate ventilation due to design and method of application.

SUMMARY

Various embodiments of the disclosure provide a ventilation system. The ventilation system includes, in one example, a vent body and a perforated barrier attached to an outer surface of the vent body. The ventilation system further includes a splash guard attached to an outer surface of the perforated barrier, where the splash guard includes a baffle formed at an angle relative to the perforated barrier. The baffle is configured to limit debris from entering through perforations in the perforated barrier.

Various embodiments of the disclosure provide a sleeved tile ridge vent (STRV). The STRV includes, in one example, a vent body including one or more holes and a perforated barrier coupled to the vent body to cover the one or more holes. The STRV further includes a splash guard coupled to the perforated barrier to limit debris from entering through perforations in the perforated barrier.

Additional embodiments and features are set forth in part in the description that follows, and will become apparent to those skilled in the art upon examination of the specification and may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

DETAILED DESCRIPTION

Figure 1:
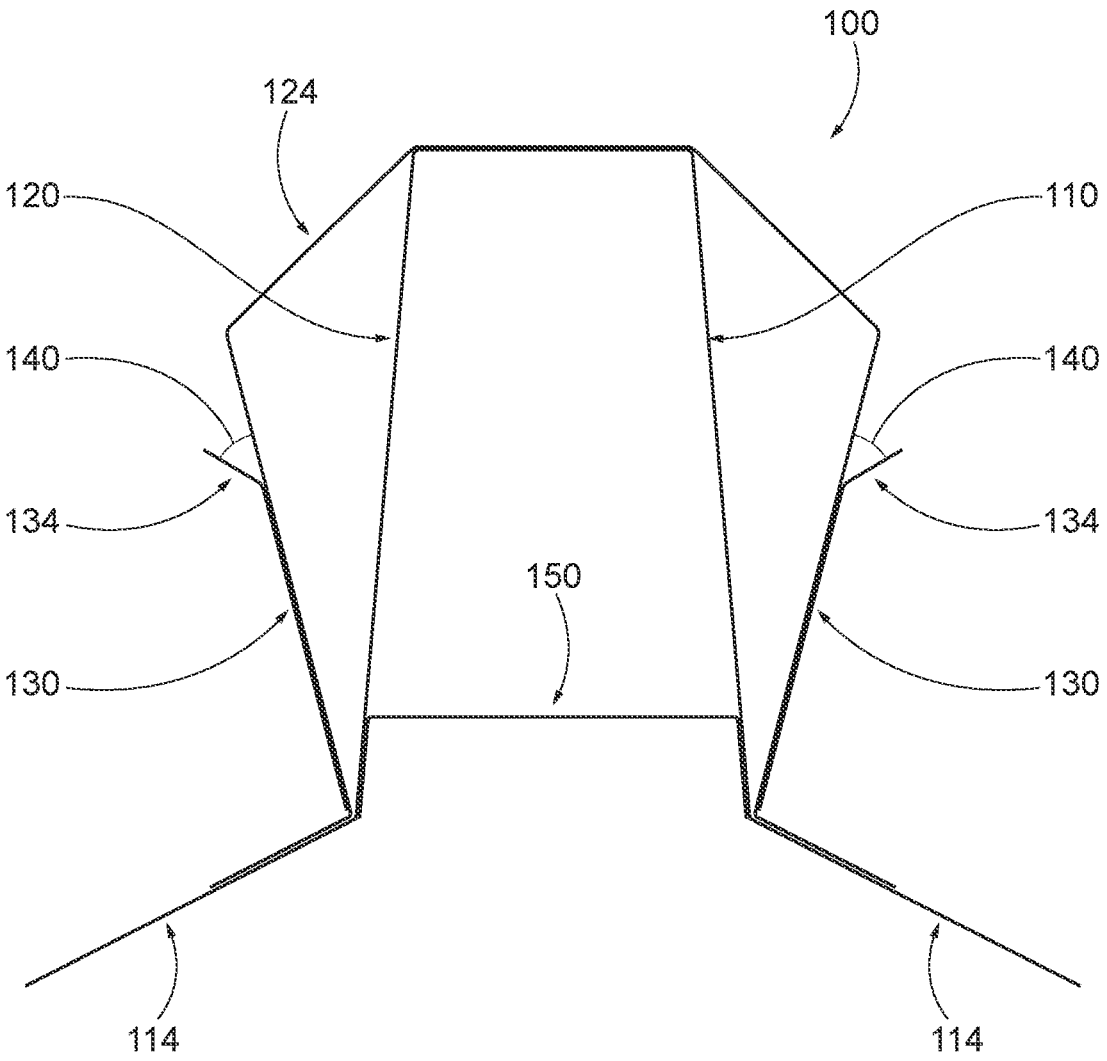
FIG. 1 illustrates a front view of an example sleeved tile roof ridge vent (STRV) as described herein.
Figure 2:
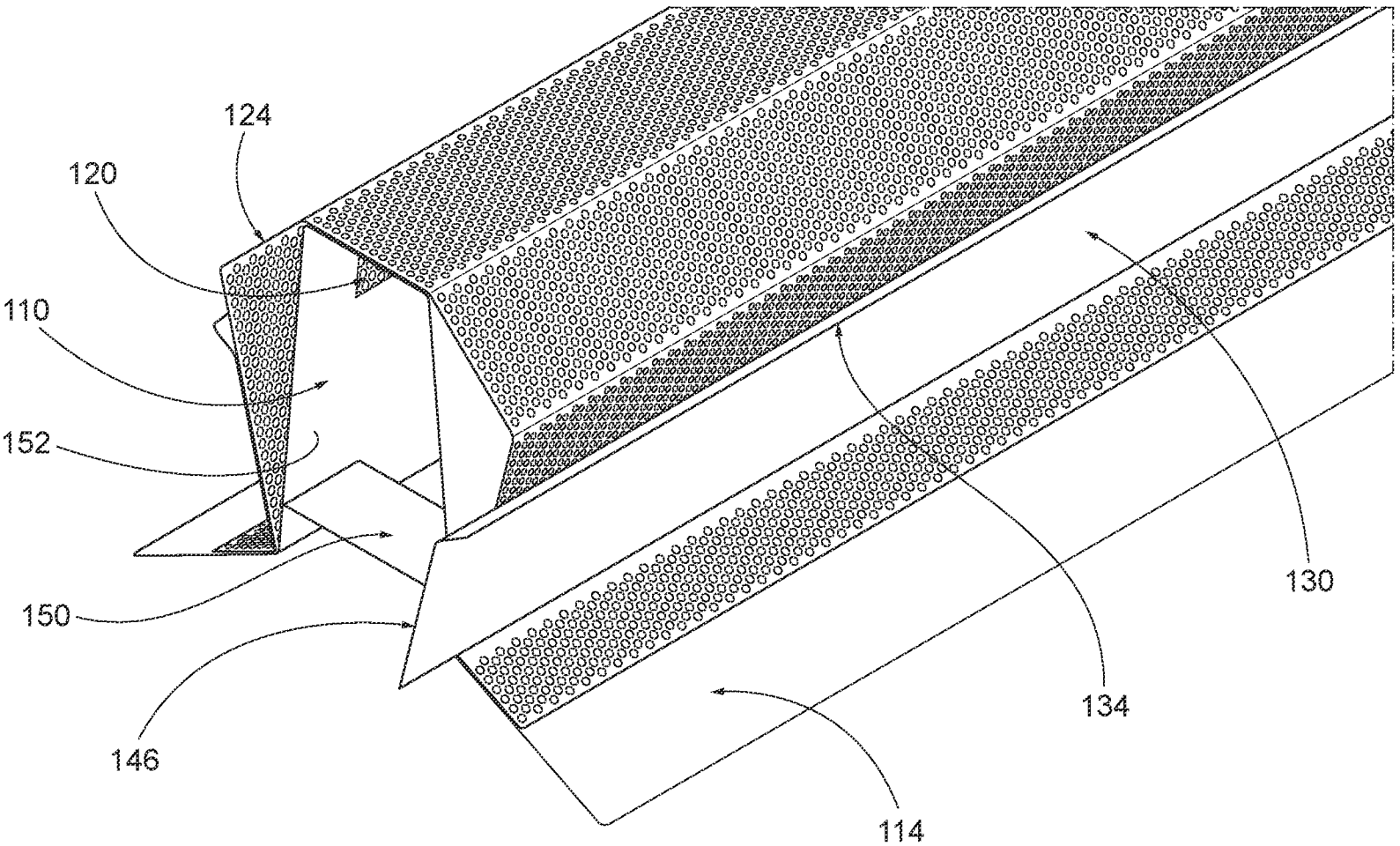
FIG. 2 illustrates a perspective view of the STRV of FIG. 1.
Figure 3:
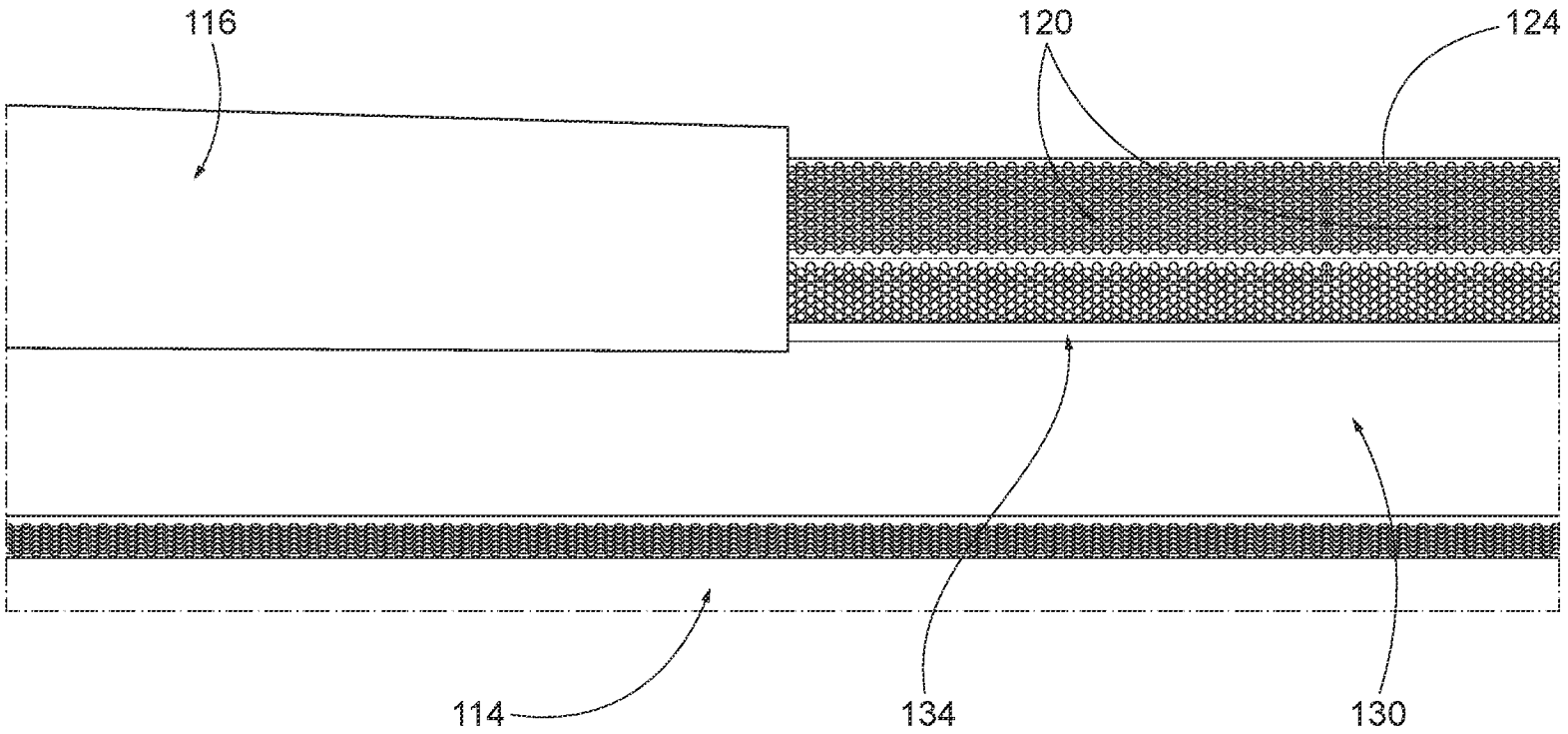
FIG. 3 illustrates a side view of the STRV of FIG. 1 and showing the STRV supporting a ridge cap tile.
Figure 4:
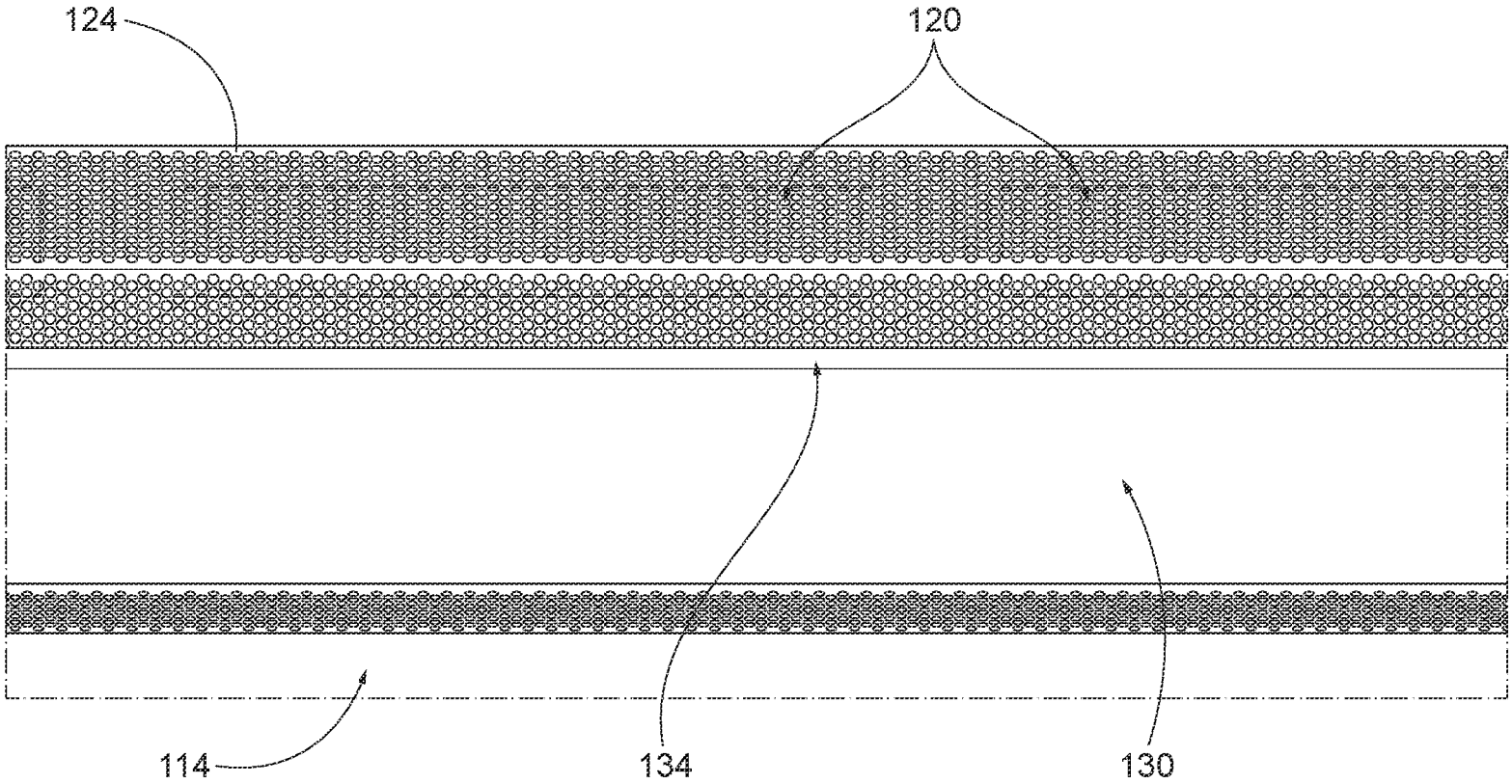
FIG. 4 illustrates another side view of the STRV of FIG. 1.
Figure 5:
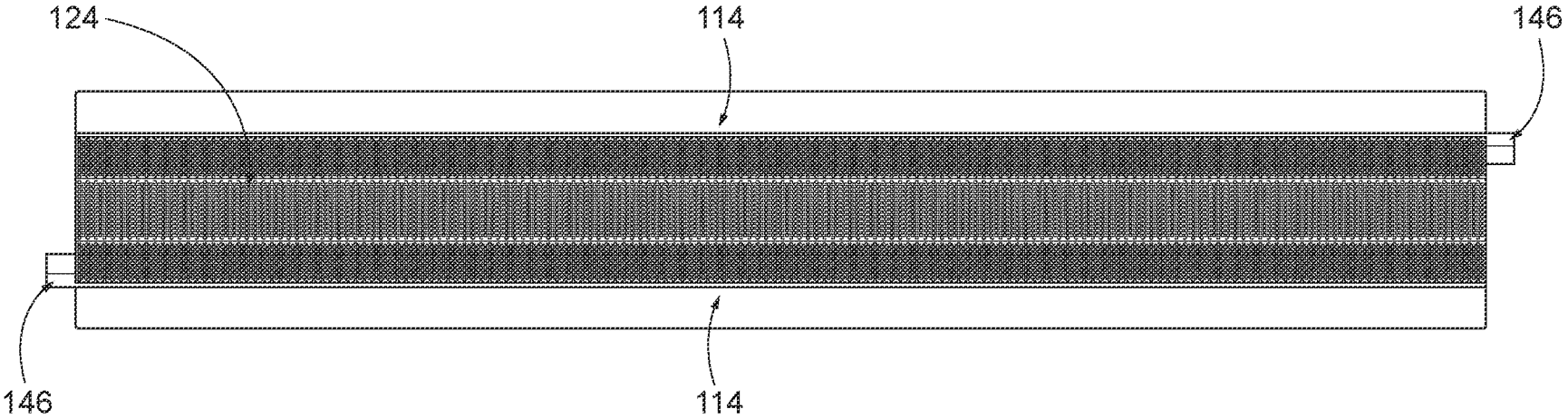
FIG. 5 illustrates a top view of the STRV of FIG. 1.
Figure 6:
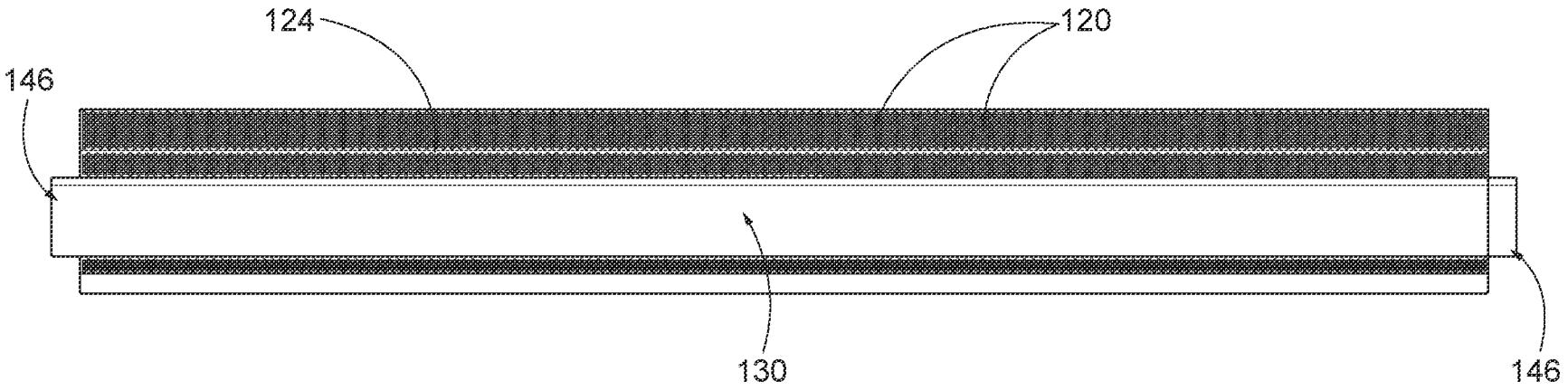
FIG. 6 illustrates another side view of the STRV of FIG. 1.
Figure 7:
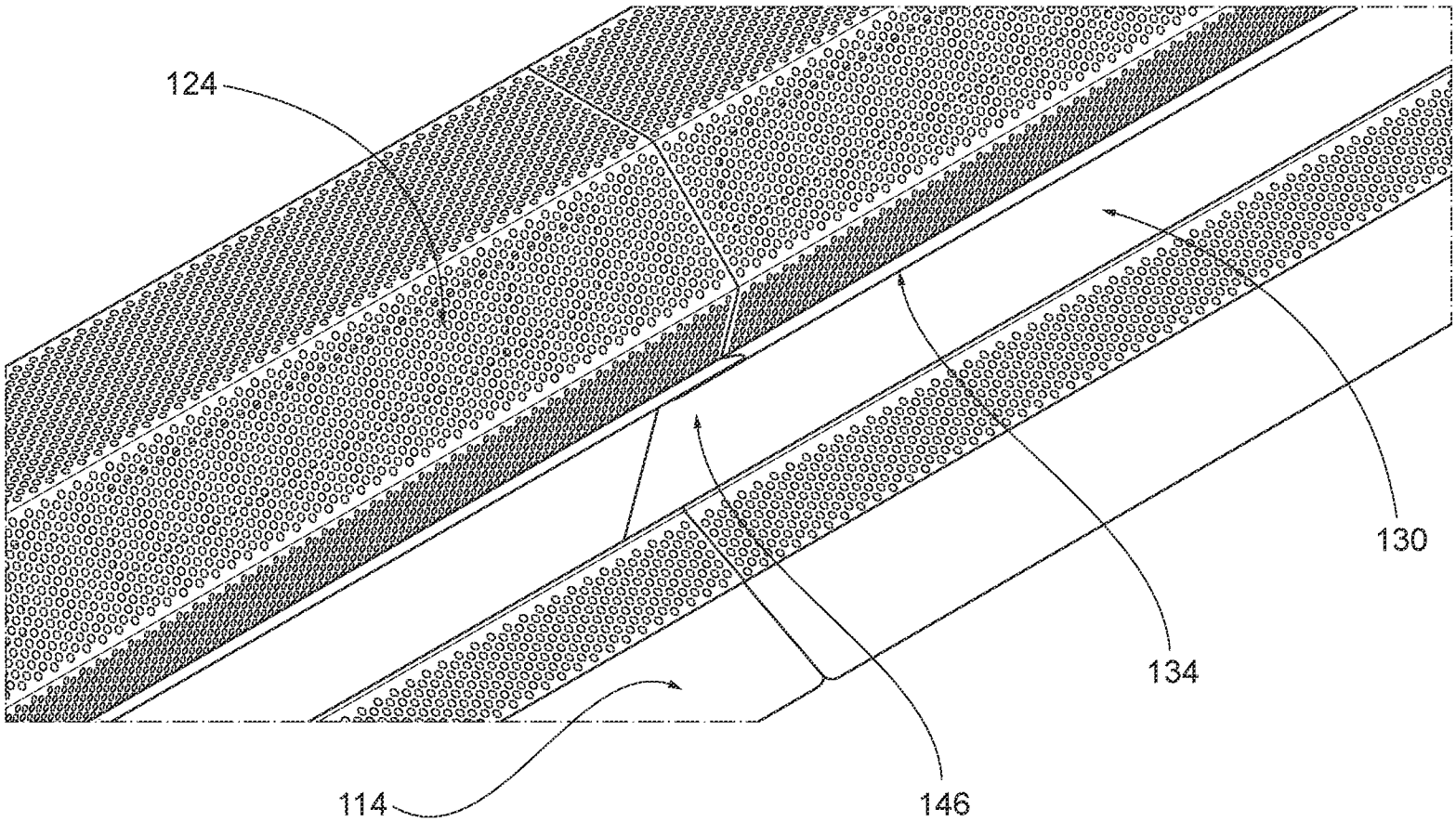
FIG. 7 illustrates a perspective view of a connection between two STRVs.

A sleeved tile roof ridge vent (STRV) and methods of its use and construction are disclosed herein. The STRV may be used with either barrel tile or flat tile roofs with a barrel ridge cap tile. The STRV may be used with clay, concrete, metal or synthetic tile roofs. The STRV may provide roof tile support and/or improved net free area (NFA) air flow for ventilation of an attic compared to some conventional vents.

FIGS. 1-7 illustrate various views and implementations of an STRV 100 as described herein. As shown, the STRV 100, which may be referred to as a ventilation system, includes a vent body 110, which may be an elongated single piece member, for example, without intent to limit. The vent body 110 may include one or more flanges 114 (e.g., ridge cut attachment flanges on both sides of the vent body 110) for attaching the STRV 100 to a roof deck (e.g., via mechanical fastening directly into the roof deck). Such fastening may be accomplished using nails, scrails, screws, or other fasteners. In embodiments, the flanges 114 may include a 180 degree hemmed edge.

The vent body 110 may double as a structural member to support the weight of a ridge cap tile 116 (see FIG. 3; or "cap tile") while also providing for sufficient air flow for venting an attic. The vent body 110 may be fabricated from a thick material, such as 26-gauge steel, to provide rigidity combined with one or more bends to support the cap weight and reinforce the roof. The vent body 110 may have elongated holes 120 on either side (e.g., on one side or on both sides of vent body 110) to allow sufficient air flow for ventilation. The vent body 110 may provide, for example, a net free area (NFA) of between 20 square inches and 25 square inches per lineal foot.

In some examples, the STRV 100 includes a perforated barrier 124 coupled to the vent body 110, such as attached to an outer surface of the vent body 110. For example, the perforated barrier 124 may be coupled (e.g., attached) to an exterior side of the vent body 110 at a top of the vent body 110 and at the flanges 114. The perforated barrier may prevent, reduce or minimize the ingress of one or more elements (e.g., burning embers) entering into the holes 120 and attic. For example, the perforated barrier 124 may by coupled to the vent body 110 to cover the holes 120. In embodiments, the perforated barrier 124 includes perforations sufficiently small in diameter to stop or limit firebrands and/or burning or smoldering embers from entry into the STRV 100 and attic. The perforated barrier 124 may also allow for adequate net free ventilation area for the egress of stale attic air while also providing resistance to the entry of wind driven rain into the STRV 100 and attic.

In some examples, the STRV further includes one or more splash guards 130 attached to the perforated barrier 124. The splash guards 130 may reduce or minimize debris (e.g., wind driven rain) entering through perforations in the bottom portion of the perforated barrier 124. The profile shape of the perforated barrier 124 combined with attached splash guards 130 may provide an angle which inhibits the upward migration of moisture and subsequent entry into the vent body 110 and attic.

Additionally, the splash guards 130 may have a formed angle that may redirect water away from the perforated barrier 124, providing additional protection from water infiltration. This angle may provide for added turbulence by a baffle 134 such that the laminar air flow caused by incoming wind bearing water is disrupted with turbulence so that moisture does not enter the vent body 110 and the attic. Water that is redirected through such disruption of laminar air flow may drain out through the exterior of the splash guard 130 and onto the flanges 114. The water therefore moves away from the STRV 100, preventing or limiting the amount of water entering into the STRV 100 or attic. The STRV 100 may include additional features such as a second formed angle at the end of the splash guard 130 to further improve both the redirection of water and the disruption of laminar air flow of wind driven rain.

As shown, the baffle 134 may be formed at an angle 140 relative to the perforated barrier 124. For example, the baffle 134 may extend away from a plane of the perforated barrier 124 by the angle 140. Depending on the application, the angle 140 may be an acute angle, such as less than 60 degrees, less than 45 degrees, or less than 30 degrees, although other configurations are contemplated.

The splash guard 130 may further include a sleeved tab 146 extending past the vent body 110. During installation of adjacent STRVs 100 on the ridge of a roof, some locations may include a roof ridge cut extending continuously from gable to gable. In these locations, some sealing is needed for joints that may be otherwise susceptible to water infiltration. Portions of the STRV 100 (e.g., portions of vent body 110 or splash guard 130) may overlap an adjacent STRV 100 such that applying sealant between adjacent vents is not required. For example, the sleeved tab 146 (and/or a sleeved tab of vent body 110) may overlap a portion of an adjacent STRV 100, such as the vent body 110 of an adjacent STRV 100 at a bottom portion of the perforated barrier 124, although other configurations are contemplated. Without such overlap by the sleeved tab 146 (and/or vent body overlap), such installation may require sealant to prevent water infiltration and migration into the STRV 100, ridge slot, and attic. Further, the sleeved tabs (e.g., sleeved tab 146) may allow an installer to install either end of the STRV 100 to be adjacent to another STRV 100 while providing sealing between the two adjacent STRVs 100. The extending sleeved tab(s) allows for installation without application of sealant to the joint between adjacent STRVs 100 and without considering the orientation of the STRV 100 with respect to the adjacent STRV 100. For example, the sleeved tab 146 may be extended on opposite sides and ends of the splash guards 130 attached to the perforated barriers 124, as shown, for example, in FIG. 5.

In embodiments, the STRV 100 may include at least one (e.g., two or more) C-shaped bridges 150. In such embodiments, the bridges 150 may be coupled (e.g., mechanically fastened) to the interior base 152 of the vent body 110 to limit or prevent the STRV 100 (e.g., vent body 110) from spreading or distorting, such as when the flanges 114 are bent to adjust the STRV 100 to the prevailing roof slope or pitch. Such spreading or distorting may occur when the flanges 114 are adapted to a lower slope or a steeper slope than a factory pre-set slope for the flanges 114.

In some examples, an optional nonwoven material may be installed between the vent body 110 and the perforated barrier 124 to provide additional protection against infiltration of snow, dust, dirt, and insects from outside of the STRV 100 and into the attic.

The STRV 100 may be partially or completely concealed from the exterior or outside, providing an aesthetic benefit. Unlike existing systems, the STRV 100 may be installed without a ridge board, and no mortar may be required for installing separate injection molded pieces. The ridge cap tile 116 and STRV 100 may generally be secured with mortar, foam, adhesive, or by mechanical fastening. Further, existing solutions may require the installation of individual brackets to separately secure the ridge board above the ridge slot. The STRV 100 described herein may be integrated such that the STRV 100 is installed as one piece without a ridge board or separate brackets and may be installed as a one-piece vent.

Figure 8:
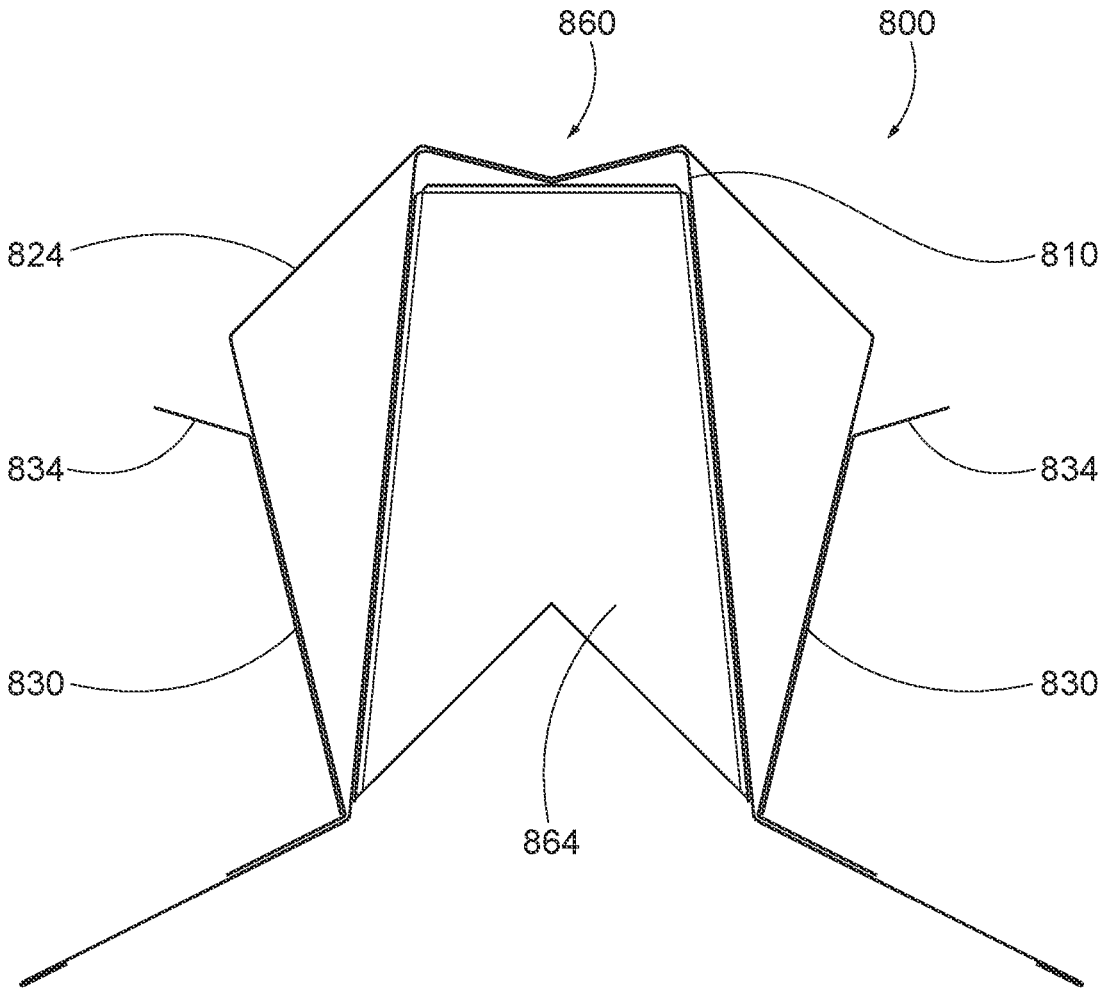
FIG. 8 illustrates a front view of another STRV as described herein.
Figure 9:
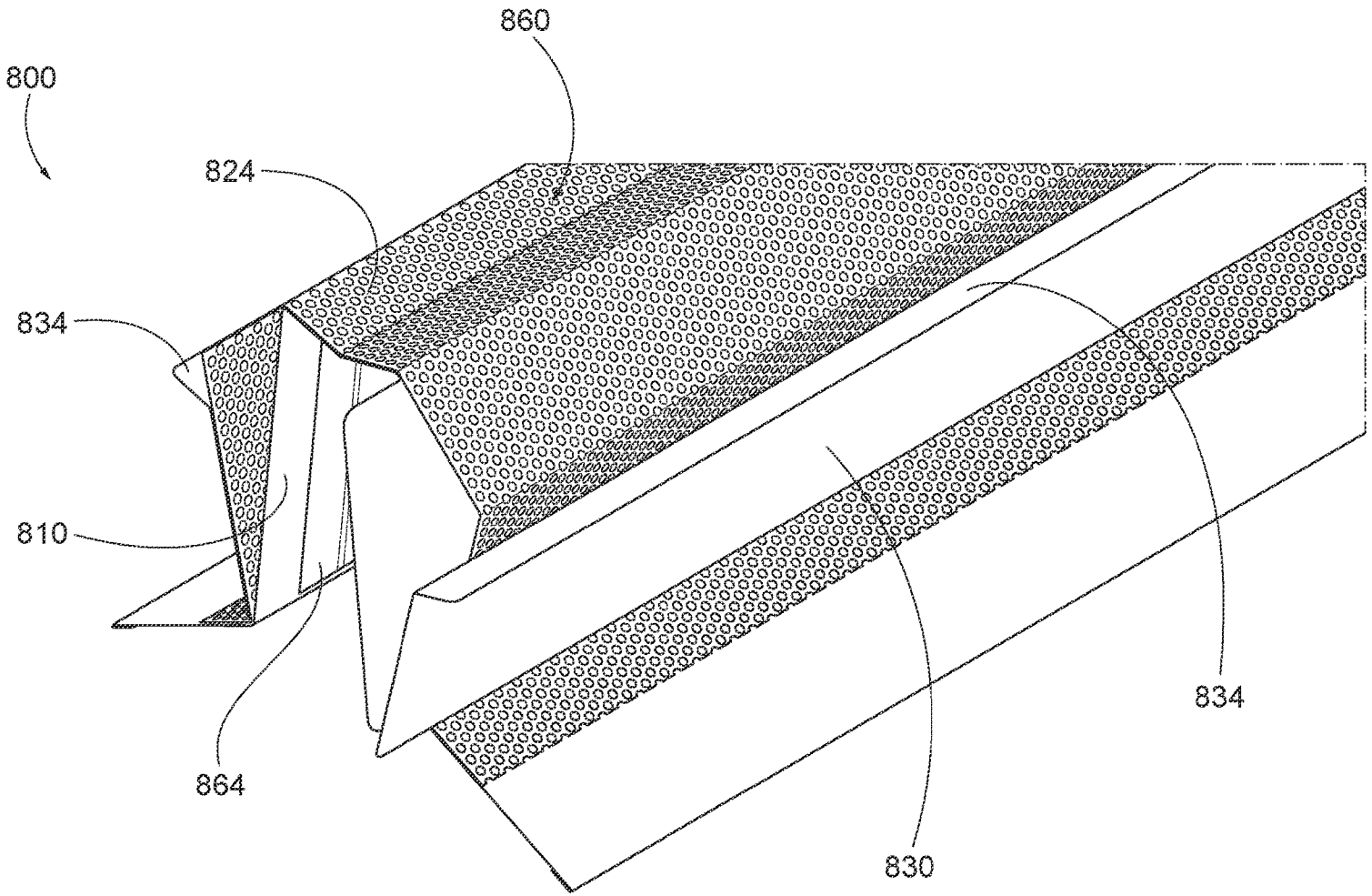
FIG. 9 illustrates a perspective view of the STRV of FIG. 8.

FIGS. 8-9 illustrate various views of another STRV 800 as described herein. Except as otherwise noted below, the STRV 800 may be similar to the STRV 100, described above. For example, the STRV 800 may be a ventilation system including a vent body 810, perforated barrier 824, splash guards 830, and baffle 834, or any combination thereof, similar to the vent body 110, the perforated barrier 124, the splash guards 130, and baffle 134, described above.

As shown in FIGS. 8-9, the top of the vent body 810 may include a V-shape (e.g., as viewed from a front or lengthwise end view shown in FIG. 8). The perforated barrier 824 may include a complementary V-shape to fit the perforated barrier 824 to the vent body 810. The V-shape may provide increased stiffening to the STRV 800, such as to support heavy ridge cap tiles, for instance. In embodiments, the V-shape may provide a cavity 860 (e.g., a lengthwise cavity at the top of the STRV 800) for laying in mortar, foam or adhesive for attaching ridge cap tiles to the top of the STRV 800.

In embodiments, the STRV 800 may include a stiffening end cap 864 coupled to the vent body 810. For example, the stiffening end cap 864 may be positioned within an interior of the vent body 810. The stiffening end cap 864 may add rigidity to the STRV 800, stiffening the STRV 800 and keeping the STRV 800 straight and preventing twisting. In embodiments, the stiffening end cap 864 may replace, or be used in conjunction with, the bridges 150. In this manner, either the bridges 150 or the stiffening end cap 864 may define an internal brace providing stiffness and/or rigidity to the vent body 110 or 810.

The ventilation systems disclosed herein may provide for concealment of the STRVs 100, 800, allowing for mortar, foam, adhesive, or mechanical fastening of a barrel ridge cap to the vents. The STRVs 100, 800 may be more simple and easier to install than existing solutions. The STRVs 100, 800 may also be used on both curved field tiles and flat field tiles, as well as being readily adaptable to different roof pitches. The STRVs 100, 800 may be utilized to prevent firebrands and flying embers from entering the vent and the attic. The sleeve tabs on the splash guards installed on opposite sides and ends of the STRVs 100, 800 may allow for installation without application of sealant at joints between vents. Adjacent vents may further be installed in any orientation. The angled ends of the splash guards combined with the perforated barriers and vent bodies may provide a multiple barrier system to prevent water infiltration while providing a high net free ventilation area.

The description of certain embodiments included herein is merely exemplary in nature and is in no way intended to limit the scope of the disclosure or its applications or uses. In the included detailed description of embodiments of the present system and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention. Of course, it is to be appreciated that any one of the examples, embodiments, or processes described herein may be combined with one or more other examples, embodiments, and/or processes or be separated and/or performed amongst separate devices or device portions in accordance with the present systems and methods.

What is claimed is:

1. A ventilation system comprising:

a vent body comprising a first flange and a second flange for attaching the ventilation system to a roof deck, a first sidewall portion extending from the first flange away from the roof deck, a second sidewall portion extending from the second flange away from the roof deck, and one or more holes defined in each of the first sidewall portion and the second sidewall portion configured to allow airflow through the vent body;

a perforated barrier covering the one or more holes and attached to outer surfaces of the first flange and the second flange, wherein the perforated barrier extends around the exterior of the vent body from the first flange to the second flange; and a splash guard engaged with an outer surface of the perforated barrier, the splash guard comprising a baffle formed at an angle relative to the perforated barrier, the baffle configured to limit debris from entering through perforations in the perforated barrier.

2. The ventilation system of claim 1, wherein the first and second flanges are at a bottom of the vent body to directly engage the roof deck.

3. The ventilation system of claim 1, wherein the perforated barrier comprises perforations sized to prevent firebrands and embers from entering through the perforations.

4. The ventilation system of claim 1, wherein the angle of the baffle is further configured to redirect water away from the perforated barrier.

5. The ventilation system of claim 1, further comprising a sleeved tab extending past the vent body at a bottom of the perforated barrier, the sleeved tab being configured to overlap a vent body of an adjacent ventilation system.

6. The ventilation system of claim 1, further comprising two or more C-shaped bridges attached to an interior base of the vent body.

7. The ventilation system of claim 1, further comprising a stiffening end cap coupled to the vent body.

8. The ventilation system of claim 1, wherein a top of the vent body comprises a pair of top edges on opposing sides of a bottom edge, the bottom edge positioned closer to the roof deck than the pair of top edges to define a V-shaped cavity.

9. The ventilation system of claim 1, wherein the debris comprises wind driven rain.

10. The ventilation system of claim 1, wherein the angle is an acute angle.

11. A sleeved tile roof ridge vent (STRV) comprising:

a vent body comprising a first flange and a second flange, a first sidewall portion extending from the first flange, a second sidewall portion extending from the second flange, and one or more holes defined in each of the first sidewall portion and the second sidewall portion configured to allow airflow through the vent body;

a perforated barrier coupled to the vent body to cover the one or more holes, wherein the perforated barrier engages the first flange, the second flange, and the exterior surfaces of the first sidewall portion and the second sidewall portion; and a splash guard coupled to the perforated barrier to limit debris from passing through perforations in the perforated barrier.

12. The STRV of claim 11, wherein the perforated barrier is attached to outer surfaces of the first flange, the second flange, the first sidewall portion, and the second sidewall portion.

13. The STRV of claim 12, wherein the splash guard is attached to an outer surface of the perforated barrier.

14. The STRV of claim 11, further comprising a baffle formed at an angle relative to the perforated barrier to limit wind driven rain from entering through the perforated barrier.

15. The STRV of claim 11, further comprising a second splash guard coupled to the perforated barrier, and sleeved tabs extended on opposite sides and ends of the splash guards, the sleeved tabs configured to overlap an adjacent STRV.

16. The STRV of claim 11, further comprising an internal brace within the vent body.

17. The STRV of claim 16, wherein the internal brace comprises at least one bridge attached to an interior base of the vent body.

18. The STRV of claim 16, wherein the internal brace comprises a stiffening end cap coupled to the vent body.

19. The STRV of claim 11, wherein a top of the vent body defines a V-shape providing a cavity for laying in mortar, foam, or adhesive, and wherein the perforated barrier includes a shape complementary to the V-shape to fit the perforated barrier to the top of the vent body.

20. The STRV of claim 11, wherein the perforated barrier extends to wrap around both sides of the vent body.

* * * * *